US006010258A

United States Patent [19]

Tomita et al.

[11] Patent Number: 6,010,258

[45] Date of Patent: Jan. 4, 2000

[54] DISPLAY SYSTEM, DISPLAY METHOD, INK RIBBON, PRINTER AND IMAGE FORMATION APPARATUS

[75] Inventors: Seijiro Tomita, Tokyo; Yuji Nishi; Mitsuo Umezu, both of Kanagawa, all of Japan

[73] Assignee: Sony Corporation, Tokyo, Japan

[21] Appl. No.: 08/952,971

[22] PCT Filed: Apr. 10, 1997

[86] PCT No.: PCT/JP97/01248

§ 371 Date: Mar. 2, 1998

§ 102(e) Date: Mar. 2, 1998

[87] PCT Pub. No.: WO97/37855

PCT Pub. Date: Oct. 16, 1997

[30] Foreign Application Priority Data

Apr. 10, 1996 [JP] Japan ..... 8-088512

[51] Int. Cl.[7] ..... B41J 2/325; B41J 31/00

[52] U.S. Cl. ..... 400/120.02; 400/120.04; 400/240.3; 347/172

[58] Field of Search ..... 400/120.02, 102.04, 400/240.3; 347/172

[56] References Cited

U.S. PATENT DOCUMENTS

| | | | |
|---|---|---|---|
| 5,095,316 | 3/1992 | Harkaku | 347/172 |
| 5,297,878 | 3/1994 | Saito et al. | 347/172 |
| 5,466,075 | 11/1995 | Kouzai et al. | 400/120.02 |
| 5,548,317 | 8/1996 | Fisch et al. | 347/172 |
| 5,611,629 | 3/1997 | Paranjpe | 400/120.02 |
| 5,712,673 | 1/1998 | Hayashi et al. | 347/172 |
| 5,815,190 | 9/1998 | Ohshima et al. | 347/172 |

FOREIGN PATENT DOCUMENTS

| | | |
|---|---|---|
| 60-46277 | 3/1985 | Japan . |
| 63-19836 | 2/1988 | Japan . |
| 3-100469 | 10/1991 | Japan . |
| 4-368858A | 12/1992 | Japan . |

*Primary Examiner*—Eugene Eickholt
*Attorney, Agent, or Firm*—Jay H. Maioli

[57] ABSTRACT

A display system wherein a photograph 110 on which an image is printed is prepared. The image data of the photograph 110 is read out by a scanner 111 to make an input. A personal computer 112 subjects the input image data to a video processing. A printer 113 prints yellow, magenta and cyan by using an ink ribbon and then prints a white image and thereafter a transparent sheet is ejected therefrom. A backlight apparatus 114 irradiates irradiation light on a print surface, where the white is printed, of the transparent sheet to thereby display the image printed on the transparent sheet.

41 Claims, 10 Drawing Sheets

DISPLAY SYSTEM, DISPLAY METHOD, INK RIBBON, PRINTER AND IMAGE FORMATION APPARATUS

This application is a 371 of pct /JPA7/01248 filed Apr. 10, 1997.

TECHNICAL FIELD

The present invention relates to a picture display system for displaying an image formed on a transparent sheet by light irradiated thereon from its rear surface.

The present invention is also an invention relating to an image forming apparatus for forming a color picture on the transparent sheet used in the picture display system.

The present invention is further an invention relating to an ink ribbon holding ink to be transferred to the transparent sheet by the picture forming apparatus.

BACKGROUND ART

A sublimation type color printer has been proposed which forms a color picture on a transferred medium such as a transparent sheet or the like by sublimating yellow, magenta and cyan inks provided on an ink ribbon by a thermal head. The transparent sheet on which a color picture is formed by the printer is generally a sheet for use in a display apparatus such as an OHP (Overhead Projector) apparatus or the like. This conventional display apparatus is an apparatus which irradiates rays of light from a light source on the transparent sheet from a rear surface thereof to project rays of light representing a picture formed on the transparent sheet on a screen.

It is an object of the present invention to provide a new display system different from such display apparatus. It is also an object of the present invention to provide an ink ribbon and a color printer most suitable for realizing the new display system.

DISCLOSURE OF THE INVENTION

The display system includes an image forming apparatus for forming a color image on a transparent sheet and a display apparatus for displaying the color image formed on the transparent sheet. The above image forming apparatus has a first process for forming a color image layer based on the color image on a rear surface of the transparent sheet by sublimating a dye containing each color components of yellow, magenta and cyan on an ink ribbon, and a second process for forming a white layer on a rear surface side of the color image layer by sublimating a dye having a color component of white on the ink ribbon after the first process. The display apparatus irradiates irradiation light from a rear surface side, where the white layer is formed, of the transparent sheet, and displays the color image on a front surface side of the transparent sheet by making the irradiation light transmit through the white layer and the color image layer.

The image forming apparatus of the display system according to the present invention includes an ink ribbon drive means for driving the ink ribbon, a storage means for storing a tension control data used for controlling a tension of the ink ribbon, and a control means for, based on a tension control data stored in the storage means, controlling the ink ribbon drive means so that tension of the ink ribbon should be set to a first tension value in the first process and controlling the ink ribbon drive means so that tension of the ink ribbon should be set to a second tension value in the second process.

In the display system according to the present invention, the second tension value is larger than the first tension value.

The image forming apparatus of the display system according to the present invention includes a transparent sheet drive means for driving the transparent sheet by one line amount in the first and second processes, and the control means controls the transparent sheet drive means and the ink ribbon drive means so that the white layer should be formed on a rear surface of the color image layer having a uniform thickness.

The image forming apparatus of the display system according to the present invention includes a storage means for storing a first reference head voltage and a second reference head voltage which are to be supplied to the thermal head as a reference head voltage, a head drive means for controlling, based on the image data and the first and second reference head voltages, a head voltage which is to be supplied to the thermal head for sublimating a dye of the ink ribbon, and a control means for controlling, in the first process, the head drive means so that the thermal head should be driven based on the first reference head voltage and for controlling, in the second process, the head drive means so that the thermal head should be driven based on the second head drive voltage.

In the display system according to the present invention, the second reference head voltage is lower than the first reference head voltage.

The control means of the image forming apparatus of the display system according to the present invention controls the head drive means such that when in the second process the display means irradiates irradiation light on the transparent sheet from the side of the white layer formed thereon, the white layer should have such a density that one part of the irradiation light is diffused thereby and the other part thereof is transmitted therethrough to the side of the color image layer.

The image forming apparatus of the display system according to the present invention further includes a transparent sheet drive means for driving the transparent sheet by one line amount in the first and second processes, and the control means controls the transparent sheet drive means and the head drive means so that the white layer should be formed on a rear surface of the color image layer with a uniform thickness.

In the display system according to the present invention, a color image transferred onto the transfer sheet in the first process is an image inverted in the left and right direction relative to the supplied image data.

In the display system according to the present invention, yellow, magenta and cyan dyes on the ink ribbon contains components used for forming the color image layer on the transparent sheet, and an ink for the white has such density and components that, when irradiation light is irradiated on the transparent sheet from the side of the white layer formed thereon, the white layer diffuses one part of the irradiation light and permits the other part thereof to be transmitted therethrough toward the side of the color image layer.

A display method according to the present invention is one for forming a color image on a transparent sheet by an image forming apparatus to display the color image formed on the transparent sheet. The display method includes a) a first printing step of forming a color image layer based on the color image by sublimating a dye containing each of yellow, magenta and cyan color components on an ink ribbon on a rear surface of the transparent sheet, b) a second printing step of, after the first printing step, forming a white layer on a rear surface side of the color image layer by sublimating a dye containing a white color component on the ink ribbon, and c) a display step of irradiating irradiation light on the transparent sheet from its rear surface side where the white layer is formed to thereby display the color image on a front surface side of the transparent sheet by transmitting the irradiation light through the white layer and the color image layer.

In the display method according to the present invention, the image forming apparatus includes an ink ribbon drive means for driving the ink ribbon and a storage means for storing a tension control data used for controlling a tension of the ink ribbon, and the image forming apparatus controls, in the first printing step, the ink ribbon drive means, based on the tension control data stored in the storage means, so that tension of the ink ribbon should be set to a first tension value and controls, in the second printing step, the ink ribbon drive means, based on the tension control data stored in the storage means, so that the tension of the ink ribbon should be set to a second tension value.

In the display method according to the present invention, the second tension value is larger than the first tension value.

In the display method according to the present invention, in the second printing step, the white layer is formed so as to, when in the display step irradiation light is irradiated on the transparent sheet from the side of the white layer formed thereon, have such a density that one part of the irradiation light is diffused thereby and the other part thereof is transmitted therethrough toward the side of the color image layer.

In the display method according to the present invention, the image forming apparatus further includes a transparent sheet drive means for driving the transparent sheet by one line amount in the first and second processes, and in the second printing step, the transparent sheet drive means and the head drive mans are controlled so that the white layer should be formed on a rear surface of the color image layer with a uniform thickness.

In the display method according to the present invention, a color image transferred onto the transfer sheet in the first step is an image inverted in the left and right direction relative to the supplied image data.

In the display method according to the present invention, yellow, magenta and cyan dyes on the ink ribbon contains components used for forming the color image layer on the transparent sheet, and an ink for the white layer has such density and components that, when irradiation light is irradiated on the transparent sheet from the side of the white layer formed thereon, the white layer diffuses one part of the irradiation light and permits the other part thereof to be transmitted therethrough toward the side of the color image layer.

An ink ribbon according to the present invention is one used for printing a color image on a transparent sheet by sublimation transfer system. Yellow, magenta and cyan inks and a white ink having a diffusion effect are repeatedly disposed in this order from the takeup side.

In the ink ribbon according to the present invention, the white ink disposed on the transparent sheet is an ink to be printed on an entire surface of the transparent sheet.

In the ink ribbon according to the present invention, yellow, magenta, cyan and white are disposed on an ink ribbon so that a color image should be printed on the transparent sheet with yellow, magenta and cyan and then a white should be printed on an entire surface thereof.

In the ink ribbon according to the present invention, the yellow, magenta and cyan inks contain components used for forming a color image layer representing the color image on the transparent sheet, and the white ink contains a component used for forming a white layer on the color image layer.

In the ink ribbon according to the present invention, the white ink contains a component for permitting a part of irradiation light irradiated from the side of the white layer to be diffused and permitting other thereof to be transmitted thereby.

In the ink ribbon according to the present invention, the white ink has such density and component that, when irradiation light is irradiated on the transparent sheet from a side of the white layer formed thereon, a part of the irradiation light is diffused by the white layer and other thereof is transmitted therethrough.

An ink ribbon according to the present invention is one used for printing a color image on a transparent sheet by sublimation transfer system. Yellow, magenta and cyan and a white sheet made of a member having no transparency are repeatedly disposed in this order from the takeup side.

In the ink ribbon according to the present invention, the white sheet disposed on the transparent sheet is a white sheet to be printed on an entire surface of a transparent sheet.

In the ink ribbon according to the present invention, yellow, magenta and cyan and a white sheet are disposed on an ink ribbon so that a color image should be printed on the transparent sheet with yellow, magenta and cyan and then the printing operation should be carried out on an entire surface thereof by using the white sheet.

In the ink ribbon according to the present invention, the yellow, magenta and cyan inks contain components used for forming a color image layer representing the color image on the transparent sheet, and the white ink contains a component used for forming a white layer on the color image layer.

In the ink ribbon according to the present invention, the white ink contains a component for permitting a part of irradiation light irradiated from the side of the white layer to be diffused and permitting other thereof to be transmitted therethrough.

In the ink ribbon according to the present invention, the white ink has such density and component that, when irradiation light is irradiated on the transparent sheet from a side of the white layer formed thereon, a part of the irradiation light is diffused by the white layer and other thereof is transmitted therethrough.

An ink ribbon according to the present invention is one for transferring dyes of respective color components of yellow, magenta, cyan and white provided on an ink ribbon to a transferred member, and includes a first memory for storing a print data of one print frame amount used for transferring dyes of the respective color components of yellow, magenta and cyan, a second memory for storing a control data used for controlling a printing operation which is different depending upon whether either of yellow, magenta and cyan images or white image is printed, and a control means for transferring dyes of the respective color components of yellow, magenta and cyan on the ink ribbon to the transferred member based on the print data and the control data respectively stored in the first and second memories and for transferring the dye of the white component onto an entire surface of the transferred member.

In the printing apparatus according to the present invention, the control data is a value with respect to tension of a supply reel for supplying the ink ribbon and a takeup reel for taking up the ink ribbon.

In the printing apparatus according to the present invention, the control data is a value with respect to tension of a supply reel for supplying the ink ribbon and a takeup reel for taking up the ink ribbon, and the value with respect to the tension is set different depending upon whether either of yellow, magenta and cyan images or a white image is printed.

In the printing apparatus according to the present invention, the control data is a value with respect to tension of a supply reel for supplying the ink ribbon and a takeup reel for taking up the ink ribbon, and the value with respect to the tension employed when white is printed is set larger than the value with respect to the tension employed when either of yellow, magenta and cyan is printed.

In the printing apparatus according to the present invention, the control data is a head voltage applied to a thermal head of the control means.

In the printing apparatus according to the present invention, the control data is a head voltage applied to a thermal head of the control means, and the head voltage is set different depending upon whether either of yellow, magenta and cyan images or a white image is printed.

In the printing apparatus according to the present invention, the control data is a head voltage applied to a thermal head of the control means, and the head voltage employed when white is printed is set larger than the head voltage employed when either of yellow, magenta and cyan is printed.

In the printing apparatus according to the present invention, there is provided a detecting means for detecting each of head portions of yellow, magenta, cyan and white of the ink ribbon.

In the printing apparatus according to the present invention, there is provided a detecting means for detecting one surface of the transferred member.

In the printing apparatus according to the present invention, the transferred member is a transparent sheet. Each of yellow, magenta and cyan images are printed on a rear surface of the transparent sheet and then white is printed on an entire rear surface thereof, thereby irradiation of irradiation light on the white printed on the entire rear surface thereof being permitted. Then, a color image printed on the transparent sheet is printed and is inverted in the left and right direction.

An image forming apparatus according to the present invention is one for forming a color image on a transparent sheet. The image forming apparatus includes a first process of forming a color image layer based on the color image on a rear surface of the transparent sheet by sublimating dyes containing respective color components of yellow, magenta and cyan on an ink ribbon, and a second process of forming a white layer on an entire surface on a further rear surface side of the color image layer by sublimating a dye containing a white component on the ink ribbon after said first process.

In the image forming apparatus according to the present invention, the white layer is such a layer that when irradiation light is irradiated on the transparent sheet from a side of its rear surface where the white layer is formed, the color image is displayed on a front surface side of the transparent sheet by a part of transmitted light transmitted through the white layer.

The image forming apparatus according to the present invention includes an ink ribbon drive means for driving the ink ribbon, a storage means for storing a tension control data used for controlling a tension of the ink ribbon, and a control means for, based on a tension control data stored in the storage means, controlling the ink ribbon drive means so that tension of the ink ribbon should be set to a first tension value in the first process and controlling the ink ribbon drive means so that tension of the ink ribbon should be set to a second tension value in the second process.

In the image forming apparatus according to the present invention, the second tension value is larger than the first tension value.

The image forming apparatus according to the present invention includes a transparent sheet drive means for driving the transparent sheet by one line amount in the first and second processes. The control means controls the transparent sheet drive means and the ink ribbon drive means so that the white layer should be formed on a rear surface of the color image layer with a uniform thickness.

The image forming apparatus according to the present invention, includes a storage means for storing a first reference head voltage and a second reference head voltage which are to be supplied to the thermal head as a reference head voltage, a head drive means for controlling, based on the image data and the first and second reference head voltages, a head voltage which is to be supplied to the thermal head for sublimating a dye of the ink ribbon, and a control means for controlling, in the first process, the head drive means so that the thermal head should be driven based on the first reference head voltage and for controlling, in the second process, the head drive means so that the thermal head should be driven based on the second reference head drive voltage.

In the image forming apparatus according to the present invention, the second reference head voltage is lower than the first reference head voltage.

The control means of the image forming apparatus controls the head drive means, in the second process, so that, when irradiation light is irradiated on the transparent sheet from the side of the white layer formed thereon, the white layer should have such a density that one part of the irradiation light is diffused thereby and the other part thereof is transmitted therethrough toward the side of the color image layer.

The image forming apparatus according to the present invention further includes a transparent sheet drive means for driving the transparent sheet by one line amount in the first and second processes. The control means thereof controls the transparent sheet drive means and the head drive means so that the white layer should be formed on a rear surface of the color image layer with a uniform thickness.

A display system includes a light for irradiating irradiation light, a reflection plate for reflecting the irradiation light from the light to guide it to an irradiation surface, and an irradiated member which is disposed so that the irradiation light from the light and then guided by the reflection plate to the irradiation surface should be irradiated on the rear surface thereof opposed to the irradiation surface, the irradiated member being printed thereon with a color image by using a printing apparatus which includes an ink ribbon having yellow, magenta and cyan inks and further having a white ink having a diffusion effect repeatedly disposed thereon in this order from a takeup side and used for printing the color image on the irradiated member by sublimation thermal transfer system, a first memory for storing a print data of one print frame amount used for transferring the dyes of the yellow, magenta and cyan components of the ink ribbon, a second memory for storing a control data for printing operations which are different depending upon the color region used in the printing operation, and a transfer means for transferring the dyes of the color components of yellow, magenta and cyan of the ink ribbon onto the irradiated member and for then transferring the dye of the white onto the irradiated member, based on the print data and the control data stored in the first and second memories.

In the display system according to the present invention, the irradiated member is a transparent sheet, and the transparent sheet is printed with each of the yellow, magenta and cyan on the rear surface thereof and the white on the entire rear surface thereof with the color image to be printed on the transparent sheet being inverted in the left and right direction, and the irradiation light is capable of being irradiated on the white printed on the entire rear surface thereof.

BEST MODE FOR CARRYING OUT THE INVENTION

The present invention will be described with reference to the accompanying drawings in order to described it in detail.

Figure 11:
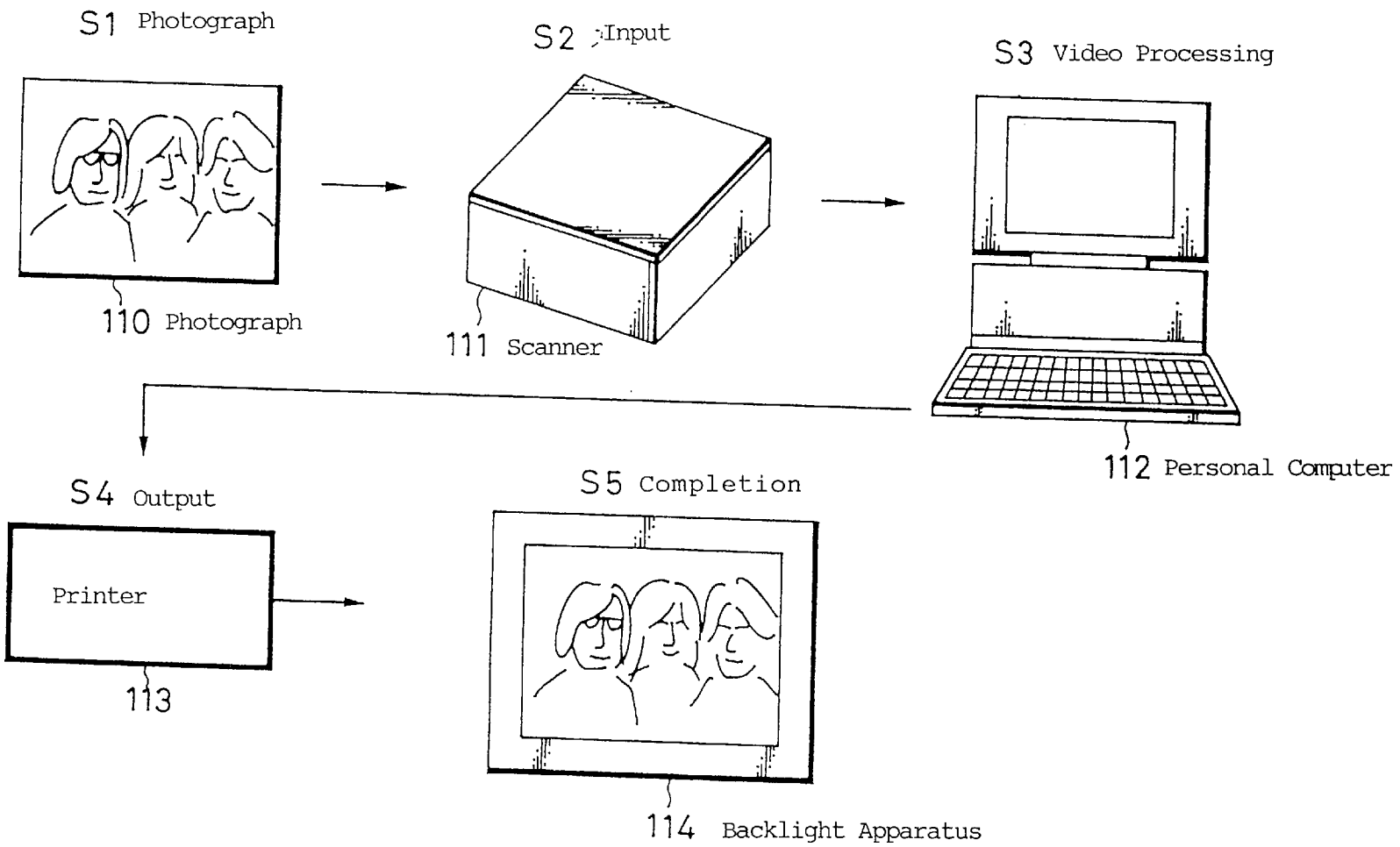
FIG. 11 is a diagram used to explain a display system using the embodiment.

A display system to which the present invention is applied will be described with reference to FIG. 11. In FIG. 11, in step S1, a photograph 110 on which a picture is printed is prepared. This photograph 110 is a printed paper, a positive film, a negative film or the like. Subsequently, in step S2, a video data of the photograph 110 is input by using a scanner 111. An illustration may be employed instead of the photograph 110, and data recorded on a CD-ROM may be input by using a CD-ROM drive apparatus instead of the scanner 111. In step S3, the input video data is video-processed by a computer such as a personal computer 112 or the like. This video processing is a processing for, for example, inserting characters and so on or combining the input video data with other graphic data. In step S4, a printer 113 prints out the video data thus processed on a transparent sheet as a dedicated color print medium. In step S5, the printed transparent sheet is set in a dedicated backlighting apparatus 114 to complete an image display.

Figure 1:
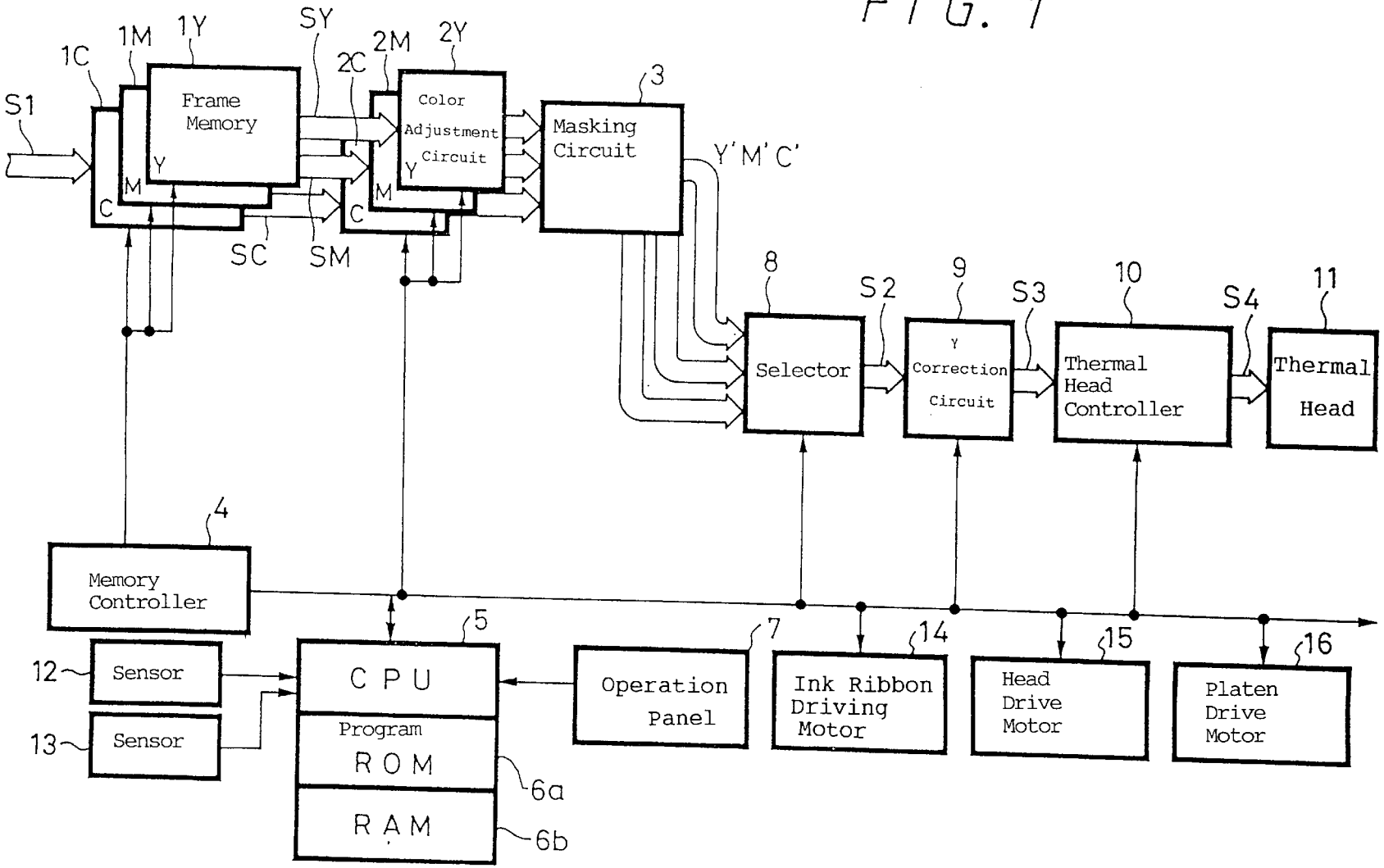
FIG. 1 is a block diagram showing an arrangement of a printing apparatus according to an embodiment of the present invention.

FIG. 1 is a diagram showing a printing apparatus (color printer) most suitable for the display system according to the embodiment. This printer has a frame memory 1 for respectively storing image data of one picture amount (one frame amount) for respective colors of yellow, magenta, and cyan, a color adjustment circuit 2 for carrying out respective color adjustments such as color corrections for yellow, magenta, and cyan, a masking circuit 3 for carrying out masking a video data for a printing processing, a memory controller 4 for controlling an operation of writing or reading video data in or from the frame memory 1, a CPU 5 for controlling operations of respective units of the printing apparatus, a program ROM 6*a* for storing various control programs, a RAM 6*b* for storing control data for a ribbon tension, a head voltage and so on required when respective colors and white color are printed, an operation panel 7 which permits an operator to carry out various settings, a selector 8 for selecting a video data of each color of yellow, magenta, or cyan, a λ-correction circuit 9 for carrying out λ-correction, a thermal head controller 10 for generating a drive signal, a thermal head 11 for carrying out a thermal transfer printing by using a thermal element, an optical sensor 12 for searching for a head of the ribbon, and an optical sensor 13 for detecting a rear surface of the transparent sheet.

This printing apparatus has an ink ribbon drive motor 14 for making the ink ribbon travel in a predetermined direction, a head drive motor 15 for moving the thermal head 11 in the up and down direction, and a platen drive motor 16 for rotating a platen.

The printing apparatus thus arranged operates as follows.

An image data S1 input from a host computer, not shown, is once written at each color in the frame memory 1 (i.e., frame memories 1Y, 1M, 1C) having a capacity of one printing area after divided into respective color data. This writing operation is controlled by the CPU 5 through the memory controller 4 connected to the CPU 5 through a bus.

The image data S1 written in the frame memory 1 is read out by the memory controller 4 at a predetermined timing. At this time, the frame memory is supplied with a reading address inverted in the left and right direction. Therefore, the image data of the respective yellow, magenta, and cyan color components read out from the frame memory 1 by the memory controller 4 are image data inverted in the left and right direction with reference to the image data supplied from the computer. The reason for inverting the image is that in this display system, the image is printed on the rear surface of the transparent sheet and a user watches the image formed on the transparent sheet from its front surface side. In particular, the image such as characters or the like which is symmetric in the left and right direction must be inverted as described above.

The color adjustment circuit 2 (2Y, 2M, 2C) for respective colors adjusts color print data SY, SM, SC respectively corresponding to yellow, magenta and cyan of the read-out image data as a user desires. Because color dyes are different from actual colors, the masking circuit 3 corrects above difference by mixing parts of the color image data SY, SM, SC with one another, and supplies corrected image data Y', M', C' to the selector 8.

Under the control of the CPU 5, the selector 8 successively selects the color image data Y', M', C' respectively corresponding to yellow, magenta and cyan in accordance with a predetermined print operation order described later on, and transmits it as a print data S2 to the λ correction circuit 9. The λ correction circuit 9 carries out conversion from density to energizing time, i.e., λ correction by using a thermal correction coefficient set based on the control of the CPU 5. The thermal head controller 10 converts a print data S3 consequently obtained in the λ correction circuit into a print energy S4, and then the thermal transfer head 11 prints an image.

Thus, this printing apparatus prints images of the respective colors of yellow, magenta and cyan based on the image data S1 supplied from the host computer and lastly prints a white image on the whole rear surface of the transparent sheet. This will be described in detail later on.

Figure 2:
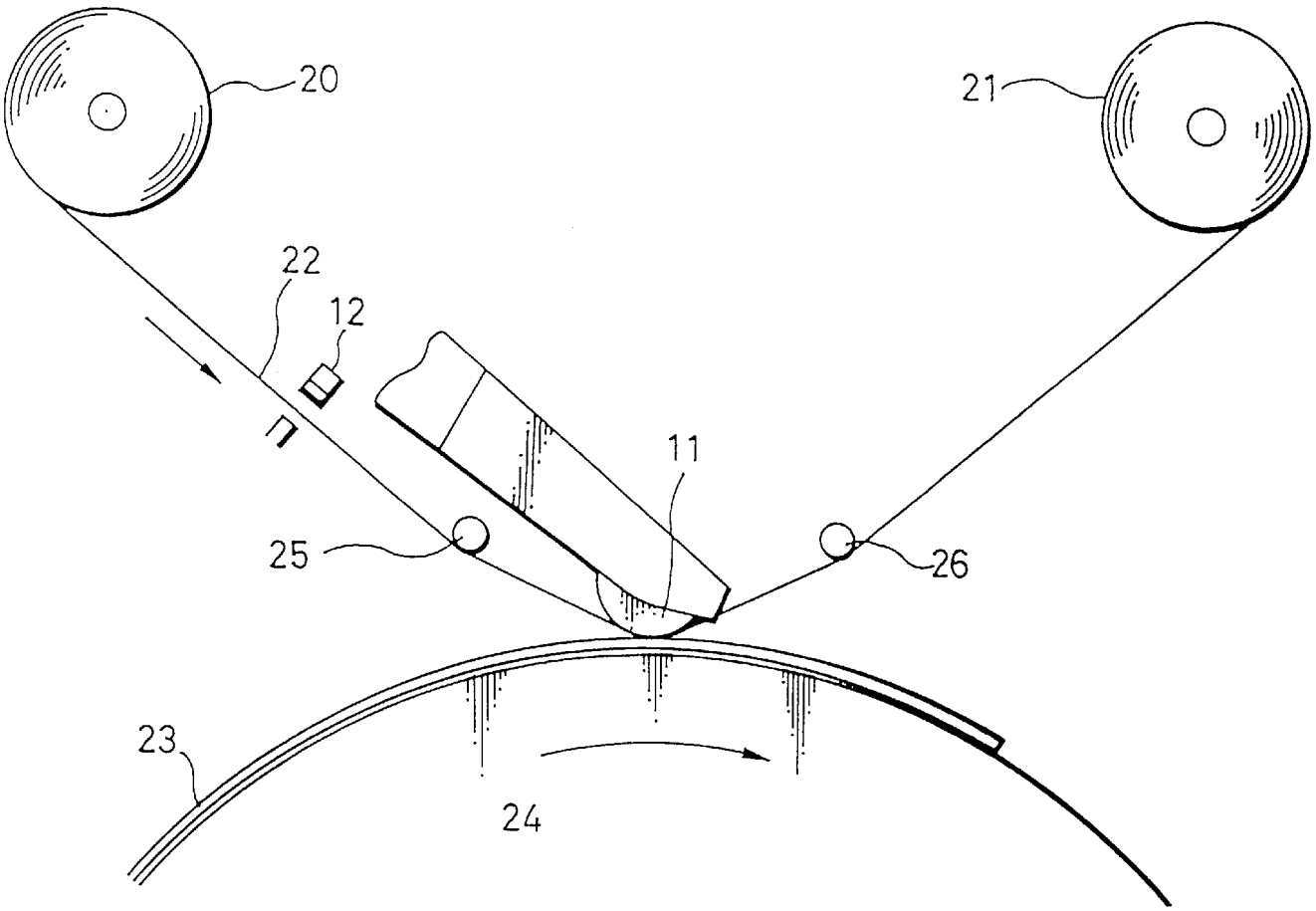
FIG. 2 is a diagram showing a printing mechanism according to the embodiment.

FIG. 2 is a diagram showing a printing mechanism of the printing apparatus. This printing mechanism has a supply reel 20 for supplying an ink ribbon, a takeup reel 21 for winding up the ink ribbon, guide rollers 25, 26 for guiding the ink ribbon to a printing position, the thermal head 11 located at the printing position between the guide rollers 25, 26, a printing paper (transparent sheet) 23 which is a transparent sheet-like printing medium, and a platen 24 for conveying the printing paper 23 to the printing position corresponding to the thermal head 11 by its rotation.

The printing mechanism thus arranged is arranged in detail as follows.

An ink ribbon 22 wound around the supply reel 20 is taken up by the takeup reel 21 rotated by the drive motor 14 while being supported by the guide rollers 25, 26. The supply reel 20 has a torque limiter, not shown, applying a back tension to the ink ribbon 22 at a constant torque. The takeup reel has a takeup detection encoder formed of an optical sensor, not shown.

On the ink ribbon 22, color dyes of yellow, magenta and cyan as dyes of one page amount are coated so as to respectively have a predetermined length. As described later on, the ribbon 22 has a page head mark and a winding diameter mark coated thereon at a head position of each of the color dyes of one page amount and has a color identification mark for identifying the color coated on the head position of each of the color dyes. Therefore, in this printing apparatus, the optical sensor 12 provided on the travel path of the ink ribbon 22 can detect the page head mark and the color identification mark, and the head portion of each of the color dyes of the ribbon 22 is posited based on the detected results.

Though not shown, a head unit provided with the thermal head 11 is detachably attached to one end of a pressing lever rotatably held by a rotation shaft. The other end of the pressing lever is swingingly attached to a cam plate through a link. Thus, the head unit is lifted up and down by rotation of the head drive motor 15 and thereby positioned to a middle position in the vertical direction, an initial position where the head unit is brought out of contact with the ribbon after being lifted up from the middle position, and a lowermost position where the head unit is lifted down from the middle position and then brought in contact with the transparent sheet 23.

Specifically, when the ribbon 22 is loaded or the like, the head unit is moved to the initial position. When the transparent sheet is mounted on the platen 24, the head unit is moved to the lowermost position. An optical sensor provided in the vicinity of a notch portion of the cam plate detects whether the head unit is being lifted up or down. The thermal head 11 is formed of an end surface type and brought in contact with the printing paper 23 through the ribbon 22 in the whole width direction of the printing paper. Therefore, when the printing paper 23 is moved in the direction shown by an arrow, a desired image is printed on the whole surface of the printing paper 23.

Figure 3:
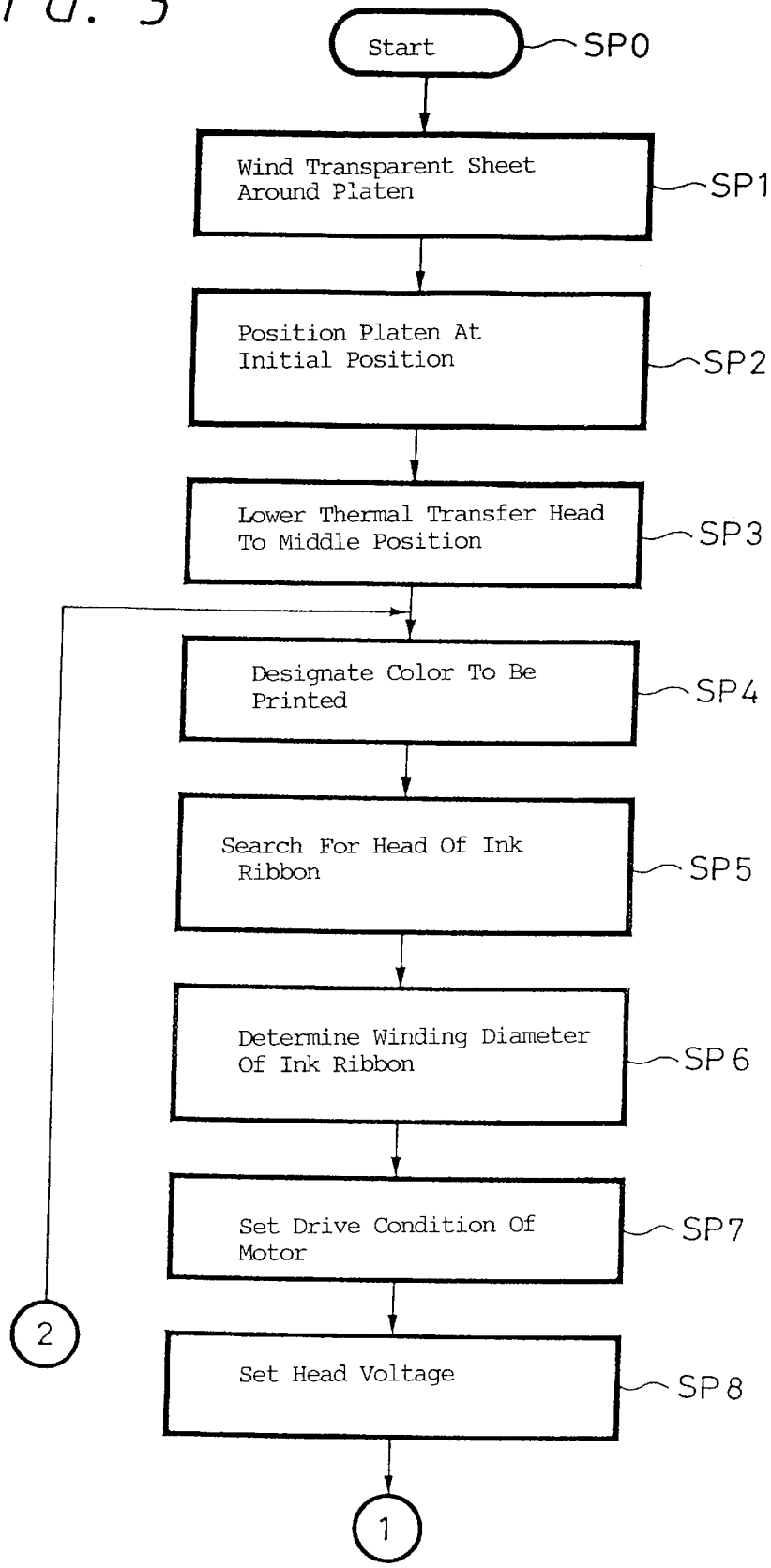
FIG. 3 is a flowchart showing a printing operation according to the embodiment.

A printing operation of the printing apparatus according to the embodiment thus arranged will be described with reference to FIGS. 3 and 4. In FIG. 3, in step SP0, the printing operation is started. In step SP1, the transparent sheet 23 is wound around the platen 24. In order to discriminate a rear surface of the transparent sheet at this time, a silver edge is formed at left and right one end portions of a conveyance-direction front end side of the transparent sheet and at left and right other portions of a conveyance-direction rear end side thereof, and an optical sensor 13 having two elements is disposed so that the two elements should be located at the positions corresponding to the left and right end portions on the transparent sheet conveyance path. This arrangement makes it possible to discriminate the rear surface of the transparent sheet when the two optical sensors 13 detect the silver edges at the left and right one end portions of the front end side and then detect the silver edges at the left and right other end portions of the rear end side. In this case, the optical sensor 13 is one of a transmission type which can discriminate the rear surface by detecting the silver edge preventing light from being transmitted therethrough. This operation is carried out when, in FIG. 2, the transparent sheet is conveyed by a conveyance roller from a paper feeding mechanism, not shown, disposed below a left side of the platen 24 to the position of the platen 24.

In step SP2, the platen 24 is positioned at its initial position. This operation is carried out when the platen 24 is rotated in the direction shown by the arrow in FIG. 2 and thereby the transparent sheet wound around the platen 24 is conveyed until the print start position thereof reaches a position corresponding to a position below the thermal head 11.

Subsequently, in step SP3, the thermal head 11 is lifted down to the middle position. This operation is carried out when the thermal head 11 is lifted down from the position where it is lifted up to the middle position by the head drive motor 15 and the middle position is detected by the encoder provided in the head drive motor 15.

In step SP4, the CPU determines the color to be printed. Since yellow is a first color the color printer most suitable for this display system prints among yellow, magneta, cyan and white, the CPU determines in this step that the color to be printed first is yellow. In this selection operation, the CPU controls the selector 8 so that an image data for yellow stored in the frame memory 1Y should be supplied to the thermal head controller 10.

In step SP5, the CPU controls the drive motor for driving the ink ribbon based on an output from the optical sensor 12 so that a head of a yellow region of the ink ribbon can be detected as the head.

Figure 6:
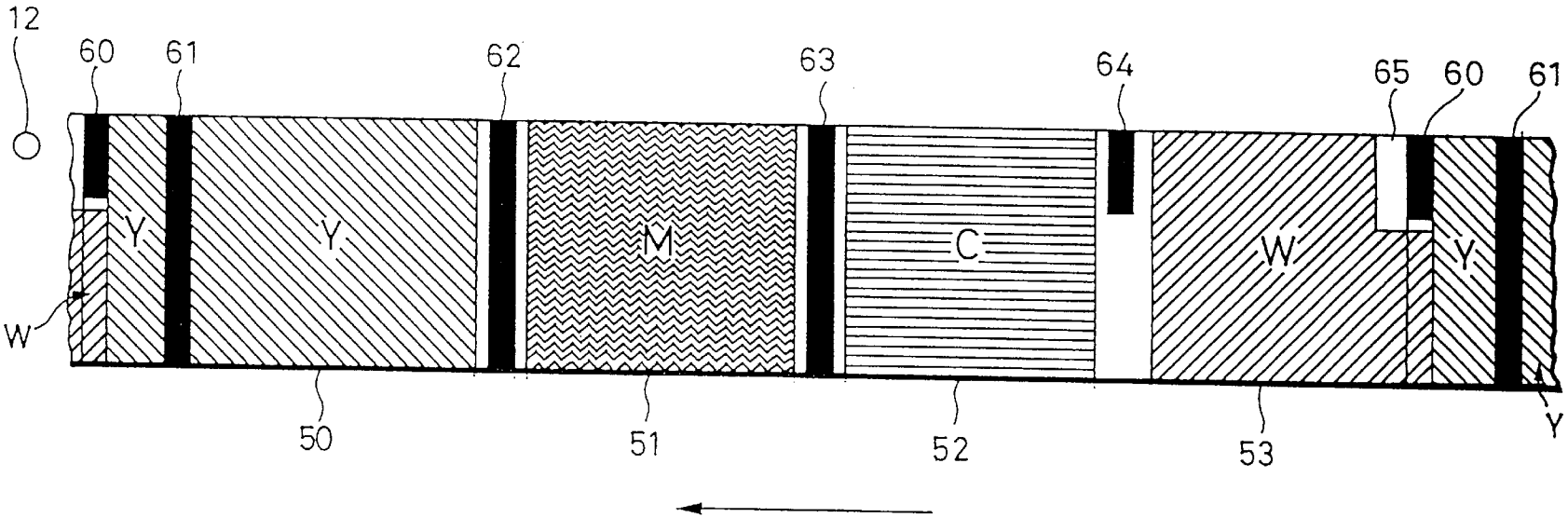
FIG. 6 is a diagram showing an operation of detecting the ribbon according to the embodiment.

Specifically, as shown in FIG. 6 which is a diagram showing a ribbon detection operation, the optical sensor 12 provided on the ribbon conveyance path and at the position above the platen 24 and corresponding to the thermal head 11 detects marks 60 and 61 provided at the head positions of a yellow region 50, a mark 62 provided at a head position of a magenta region 51, a mark 63 provided at a head position of a cyan region 52, and a mark 64 provided at a head position of a white region 53, and thereby the ribbon detecting operation is carried out. The optical sensor 12 is of a transmission type and can detect the respective marks 60 to 64 preventing light from being transmitted therethrough to thereby detect which color region is located next. In particular, since the yellow region 50 is located at the head of the ribbon subjected to the printing operation and its position must repeatedly be detected upon every printing operation, the yellow region is distinguished from other regions by providing the two marks 60 and 61. Since the white region 53 is used to print white image on the whole rear surface of the transparent sheet, start and end positions of the white region can be detected by providing the mark 64 indicating the start position of the white region 63 and a blank 65 indicating an end position thereof. The encoder provided in the ribbon drive motor detects that the ribbon drive motor is rotated by a predetermined rotation number after the optical sensor 12 detects the mark indicating the head position of each of the color regions, thereby discrimination of a print range of each of the color regions is enabled. The ink ribbon head searching operation is carried out for an operation of printing each of the color images by one page amount.

In step SP6, the CPU determines how much the ink ribbon is used, based on the number of printing processings stored in the RAM 6*b*, and determines the winding diameter of the ink ribbon in response to a used state of the ink ribbon.

In step SP7, the CPU sets a drive condition of the ribbon drive motor 14. Specifically, the CPU sets a tension value corresponding to the color to be printed determined in step SP4, with reference to data of an ink ribbon tension table stored in the RAM 6*b*.

The reason for changing the reel tension value in response to the color to be printed as described above will be described.

In the color printer according to the present invention, in order to prevent the ribbon from being slack upon taking up the ribbon, different tensions are set for the ribbon supply reel 21 and the ribbon takeup reel 20. The data stored in the ink ribbon tension table is used to respectively set the values of the supply reel 21 and the takeup reel 20 to 500 and 200 (these numbers represent a torque ratio) when the images of yellow, magenta and cyan are printed and also used to respectively set the values of the supply reel 21 and the takeup reel 20 to 500 and 1200 when white is printed. The reason for setting the torque ratio of the ribbon takeup reel 20 higher for printing the white is to prevent the ribbon from sticking to the transparent sheet because the white is printed on the entire rear surface of the transparent sheet.

Accordingly, in step SP7, since the color to be printed is yellow, the CPU sets the torque value of the ribbon drive motor 14 for driving the takeup reel to 900 based on the data of the ink ribbon tension table.

In step SP8, the CPU sets a head voltage supplied to a thermal element of the thermal head 11. Specifically, with reference to data of a head voltage table stored in the RAM 6*b*, the CPU controls the thermal head controller 10 so that the thermal head controller should set the head voltage in response to the print color determined in step SP4. Assuming that a voltage value (e.g., 10 V) used when the color printing is carried out with highest density is a default value upon shipment from a factory, the data set in the head voltage table are used to, with employing the default value as a standard value, set the head voltage value to a standard value −0.3 V when images of yellow, magenta and cyan are printed and set the head voltage value to a standard value −1.5 V when white is printed. The reason for setting the head voltage used for printing white lower is that since the image of white is printed on the whole rear surface of the transparent sheet and hence the white region of the ink ribbon easily sticks to the transparent sheet as compared with the yellow, magenta and cyan regions, the head voltage is set as low as possible when white is printed in order to prevent the white region from sticking to the transparent sheet.

Therefore, in step SP8, since the color to be printed is yellow, the CPU controls the thermal head controller 10 so that the standard voltage supplied to the thermal head 11 should be set to 9.7 V (=10 V−0.3 V) based on the data of the head voltage table.

Figure 4:
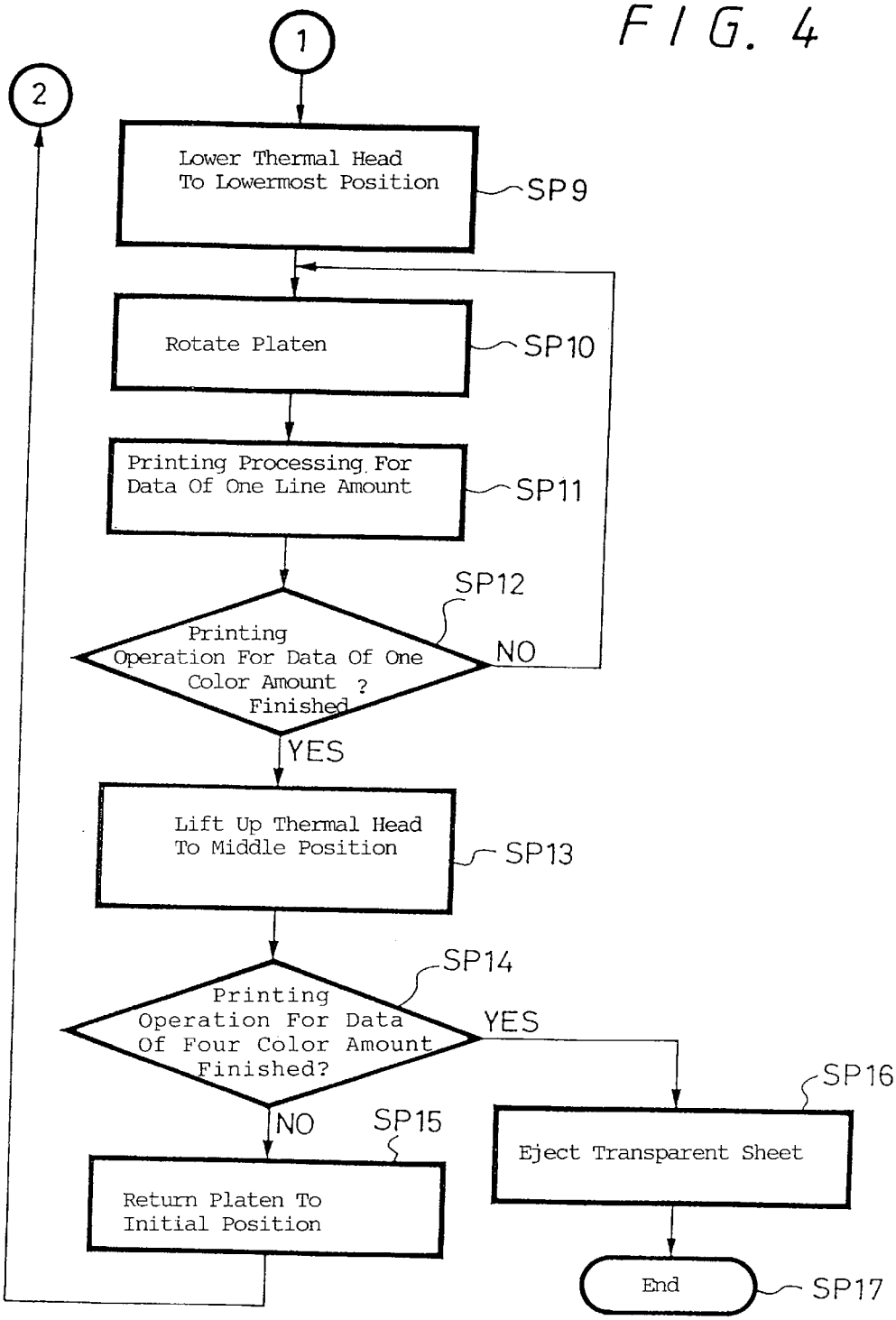
FIG. 4 is a flowchart showing the printing operation according to the embodiment.

Referring to FIG. 4, in step SP9, the thermal head 11 is lifted down by the head drive motor 15 to the lowermost position. This operation is carried out by lifting the thermal head 11 down to the lowermost position from the middle position by the head drive motor 15 and detecting the lowermost position by the encoder provided in the head drive motor 15. When the thermal head 11 is lifted down to the lowermost position, the ribbon drive motor 14 starts taking up the ribbon and in step SP10, a platen drive motor 16 rotates the platen by one line amount.

In step SP11, the CPU supplies the print data of one line amount from the frame memory 1Y to the thermal head controller 10. The thermal head 11 forms an image of the yellow component of one line amount on the transparent sheet in response to the print data.

In step SP12, the CPU determines whether or not the print processing of one frame amount is finished. If it is determined that the print processing of one frame amount is finished, the processing proceeds to step SP13. If it is determined in this step that the print processing of one frame amount has not been finished, then the processing returns to step SP10. Until the print processing of one frame amount is finished, the processings in steps SP11 and SP12 are repeatedly carried out. The CPU can determine whether or not the printing processing of one frame amount is finished, by determining whether or not the print processings in step SP11 for all the lines in one frame (965 lines in this apparatus) is finished.

In step SP13, the CPU controls the head drive motor so that the thermal head should be lifted up to the middle position.

Next, in step SP14, it is determined whether or not printing processes of yellow, magenta, cyan and white have been finished. If it is determined that they have not been finished, then in step SP15 the platen is returned to its initial position and the processing returns to step SP4. If it is determined in step SP14 that the printing processings for four colors have been finished, the n in step SP16 the transp parent sheet is ejected and the processing is ended.

In this case, since the printing process of yellow is not finished, the processing returns to step SP4.

In step SP4 during the second processing loop, the CPU designates magenta as the color to be printed next to yellow.

In step SP5, the CPU controls the ribbon drive motor 14 for driving the ink ribbon based on the output from the optical sensor 12 so that the head of the magnet region of the ink ribbon should be searched for.

In step SP6, the CPU determines, based on the number of the printing processings stored in the RAM 6*b*, how much the ink ribbon is used, and determines the winding diameter of the ink ribbon in response to the used state of the ink ribbon.

In step SP7, the CPU sets a drive condition of the ribbon drive motor 14. In step SP8, the CPU sets the head voltage supplied to the thermal element of the thermal head 11.

In step SP9, rotation of the head drive motor 15 brings the thermal head 11 down to the lowermost position. In step SP10, the platen is rotated by the platen drive motor 16 by one line amount. Subsequently, in step SP11, the CPU supplies the print data of one line amount from the frame memory IM to the thermal head controller 10. In step SP12, the CPU determines whether or not the printing processing of one frame amount is finished, and if the CPU determines that the printing processing of one frame amount is finished, then the processing proceeds to step SP13. In step SP13, the CPU controls the head drive motor 15 so that the thermal head 11 should be lifted up to the middle position. In step SP14, it is determined whether or not the printing processings for images of yellow, magenta, cyan and white are finished, and if it is determined that all of them have not been finished yet, in step SP15, the platen is returned to its initial position and then the processing returns to step SP4.

In step SP4 during the third processing loop, the CPU designates cyan as the color to be printed next to magenta.

In step SP5, the CPU controls the ribbon drive motor 14 for driving the ink ribbon based on the output from the optical sensor 12 so that the head of the magnet region of the ink ribbon should be searched for.

In step SP6, the CPU determines, based on the number of the printing processings stored in the RAM 6*b*, how much the ink ribbon is used, and determines the winding diameter of the ink ribbon in response to the used state of the ink ribbon.

In step SP7, the CPU sets a drive condition of the ribbon drive motor 14. In step SP8, the CPU sets the head voltage supplied to the thermal element of the thermal head 11. In step SP9, rotation of the head drive motor 15 brings the thermal head 11 down to the lowermost position. In step SP10, the platen is rotated by the platen drive motor 16 by one line amount. Subsequently, in step SP11, the CPU supplies the print data of one line amount from the frame memory 1C to the thermal head controller 10. In step SP12, the CPU determines whether or not the printing processing of one frame amount is finished, and if the CPU determines that the printing processing of one frame amount is finished, then the processing proceeds to step SP13. In step SP13, the CPU controls the head drive motor 15 so that the thermal head 11 should be lifted up to the middle position. In step SP14, it is determined whether or not the printing processings for images of yellow, magenta, cyan and white are finished, and if it is determined that all of them have not been finished yet, in step SP15, the platen is returned to its initial position and then the processing returns to step SP4.

In step SP4 during the fourth processing loop, the CPU designates white as the color to be printed after cyan.

In step SP5, the CPU controls the ribbon drive motor 14 for driving the ink ribbon based on the output from the optical sensor 12 so that the head of the white region of the ink ribbon should be searched for.

In step SP6, the CPU determines, based on the number of the printing processings stored in the RAM 6*b*, how much the ink ribbon is used, and determines the winding diameter of the ink ribbon in response to the used state of the ink ribbon.

In step SP7, the CPU sets a drive condition of the ribbon drive motor 14. Specifically, the CPU sets the tension value corresponding to the print color, i.e., white with reference to the data of the ink ribbon tension table stored in the RAM 6*b*.

In step SP8, the CPU sets the head voltage supplied to the thermal element of the thermal head 11. Specifically, the CPU controls the thermal head controller 10, with reference to the data of the head voltage table stored in the RAM 6*b*, so that the head voltage corresponding to the print color, i.e., white should be set.

Thus, when the white is printed, it is possible to prevent the transparent sheet and the ink ribbon from being bonded to each other by setting the head voltage as low as possible.

Therefore, in step SP8, since the color to be printed is white, the CPU controls the thermal head controller 10 based on the data of the head voltage table so that the standard voltage supplied to the thermal head 11 should be 8.5 V (=10 V 1.5 V).

In step SP9, the thermal head 11 is lifted down to the lowermost position by the rotation of the head drive motor 15. In step SP10, the platen is rotated by one line amount by the platen drive motor 16. In step SP11, the image data S2 is not output from the selector 8. In step SP12, the CPU determines whether or not the printing processing for one frame amount is finished, and if it is determined that the printing processing for one frame amount is finished, then the processing proceeds to step SP13.

In step SP13, the CPU controls the head drive motor so that the thermal head is lifted up to the middle position.

In step SP14, it is determined whether or not the printing processings for yellow, magenta, cyan and white are finished. Since all of them have already been finished, in step SP16, the transparent sheet is ejected, and then the processing is ended.

Thus, it is possible to obtain a color print having no light transmittance from the front surface of the transparent sheet by printing colors of yellow, magenta and cyan on the rear surface of the transparent sheet by mirror printing with inverting the print data in the left and right direction and by further printing a white color on the entire rear surface thereof.

Figure 7:
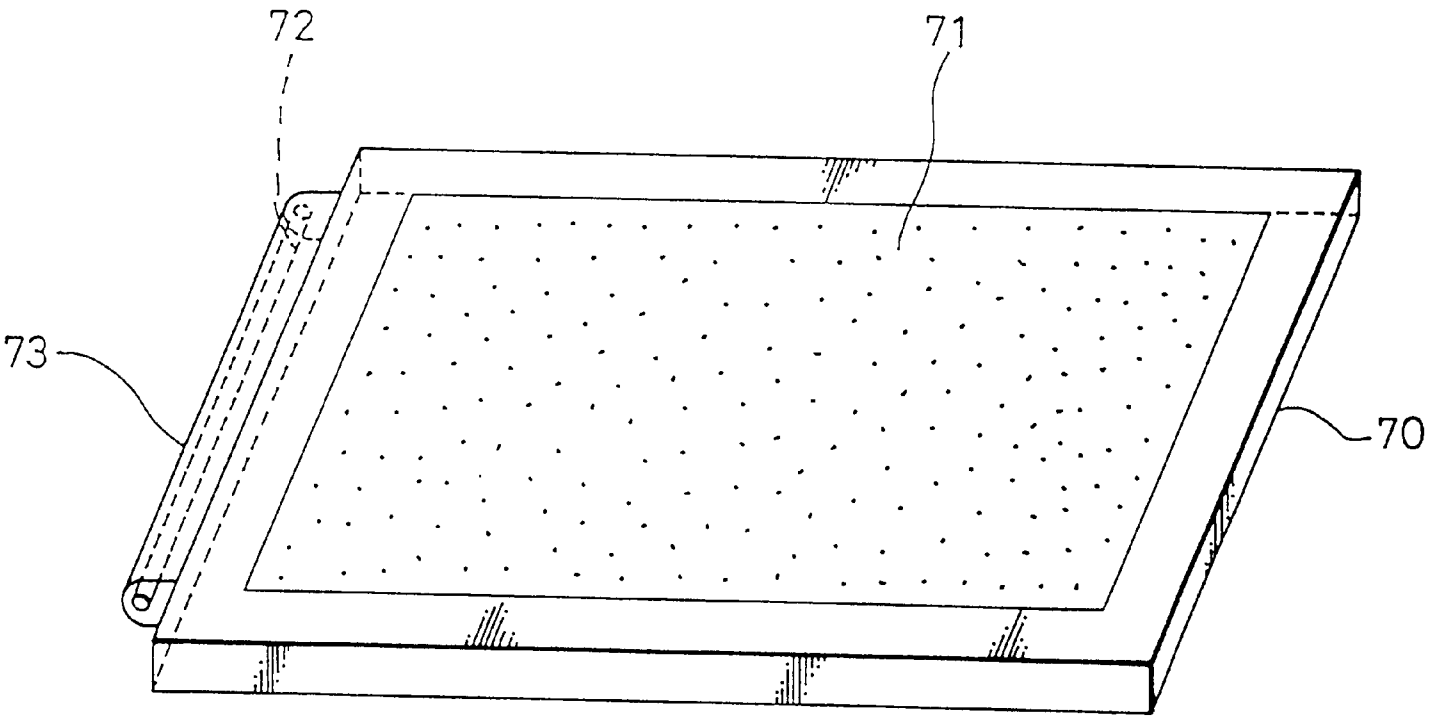
FIG. 7 is a schematic, perspective view showing a back-lighting apparatus according to the embodiment.

A backlight display apparatus for displaying an image printed on the transparent sheet by such printing apparatus will be described with reference to FIGS. 7 and 8. This backlight apparatus, as shown in FIG. 7 which is a schematic, perspective view thereof, has a box-shaped frame 70 having opening portions at its upper surface and its one side end portion, a mesh plate 71 having small apertures formed in a mesh pattern and provided so as to cover the upper surface opening portion of the frame 70, a backlight 72 provided at the opening portion of the one side end portion of the frame 70 in the lengthwise direction of the side end side, and a gutter-shaped reflection plate 73 covering a circumference of the back light 72 and having an opening portion corresponding to the opening portion of the one side end portion of the frame 70.

Figure 8:
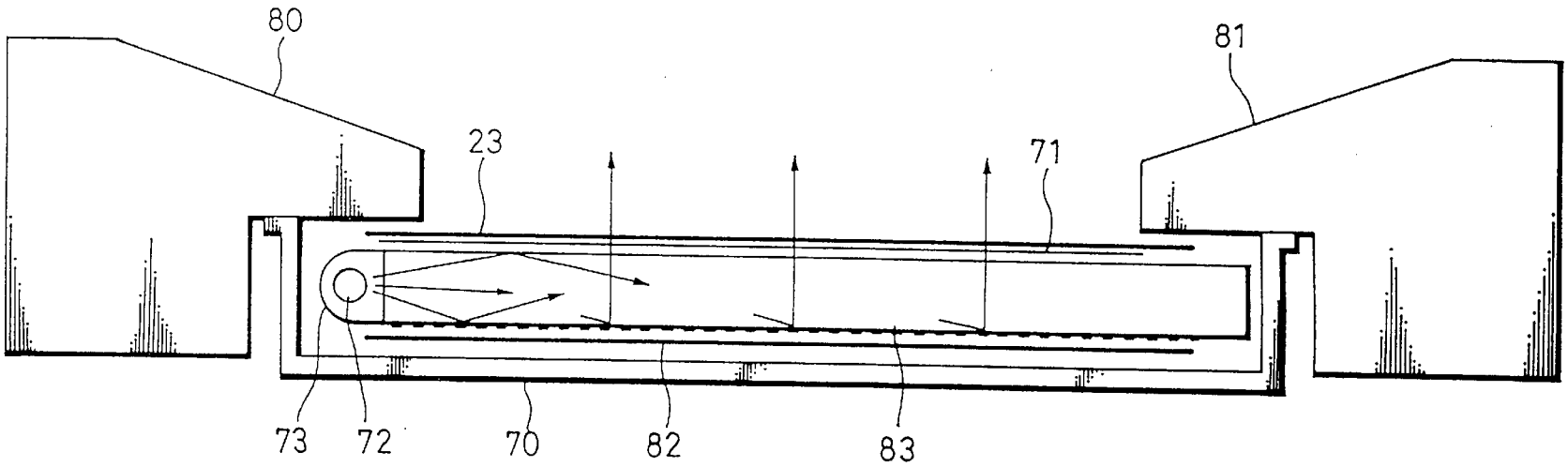
FIG. 8 is a cross-sectional view showing in detail an operation of the backlighting apparatus according to the embodiment.

This backlight display apparatus, as shown in FIG. 8 which is a detailed, cross-sectional view thereof, has frames 80, 81 provided so as to cover a circumference of the frame 70, a reflection plate 82 provided on the inner bottom surface side of the frame 70, a light guide plate 83 having an opening portion provided through its upper surface for guiding light from the back light 72 to the inside of the frame 70, a reflection pattern provided on a rear surface of the light guide plate 83, the mesh plate 71 having small apertures provided in a mesh pattern and provided so as to cover the opening portion of the upper surface of the frame 70, the backlight 72 provided at the opening portion of the one side end portion of the frame 70 in the lengthwise direction of the side end side, the gutter-shaped reflection plate 73 covering a circumference of the backlight 72 and having the opening portion corresponding to the opening portion of the one side end portion of the light guide plate 83, and the transparent sheet 23 disposed on the upper surface of the mesh plate 71. The backlight 72 is a cold-cathode discharge tube which is driven by a high AC voltage supplied from an invertor, not shown, and emits rays of white light.

The backlight apparatus thus arranged is operated as follows. The rays of light emitted from the backlight 72 travel through inside of the light guide plate 83 and are reflected totally on the front surface or the rear surface having no reflection pattern but reflected randomly on another portion of the rear surface having the reflection pattern. Therefore, the rays of light are reflected toward a front surface of the reflection pattern and hence irradiated on the transparent sheet 23 from its rear surface side. Brightness is set uniform throughout the entire surface by changing density and sizes of dots of the reflection pattern so that an area ratio of the reflection pattern per a unit area should become larger as the dot is located away from the backlight 72.

Figure 9:
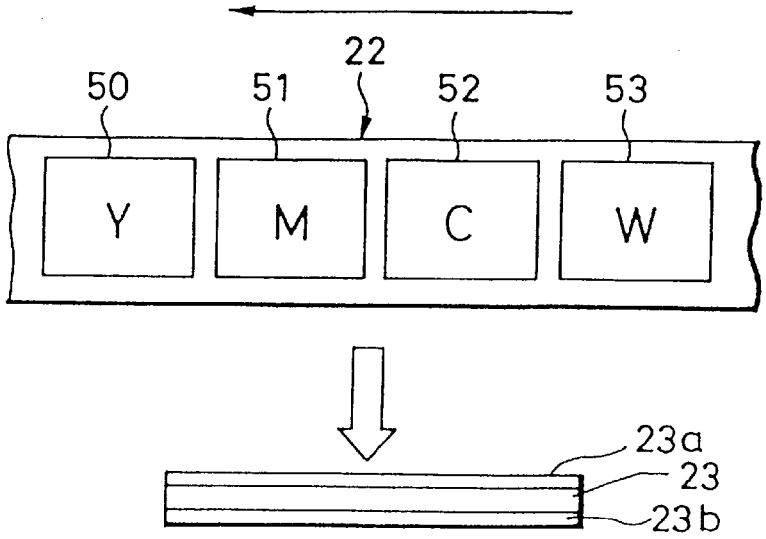
FIG. 9 is a diagram used to explain the printing according to the embodiment.
Figure 10:
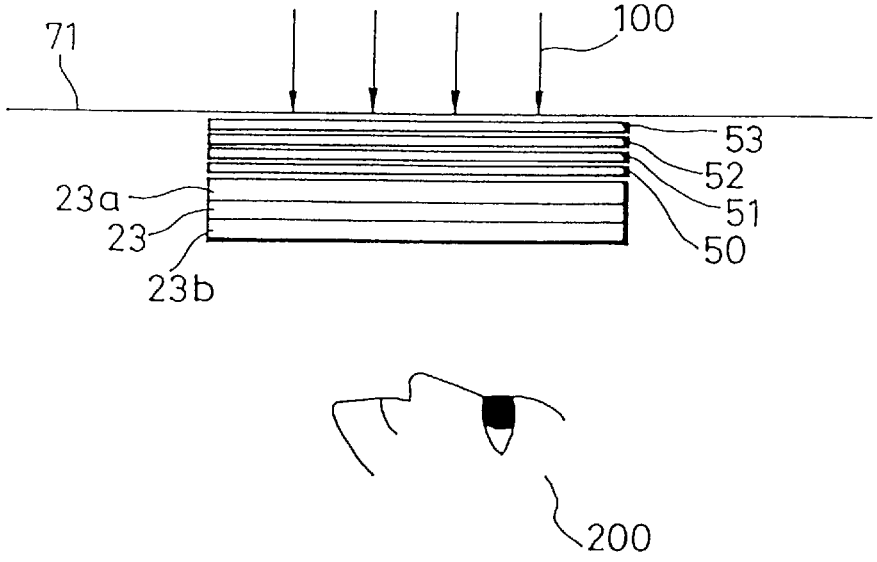
FIG. 10 is a diagram used to explain a display carried out by back-lighting according to the embodiment.

A method of forming an image on the transparent sheet in the display system according to the present invention and a method of displaying the image on the transparent sheet will schematically be described with reference to FIGS. 9 and 10.

Figure 5:
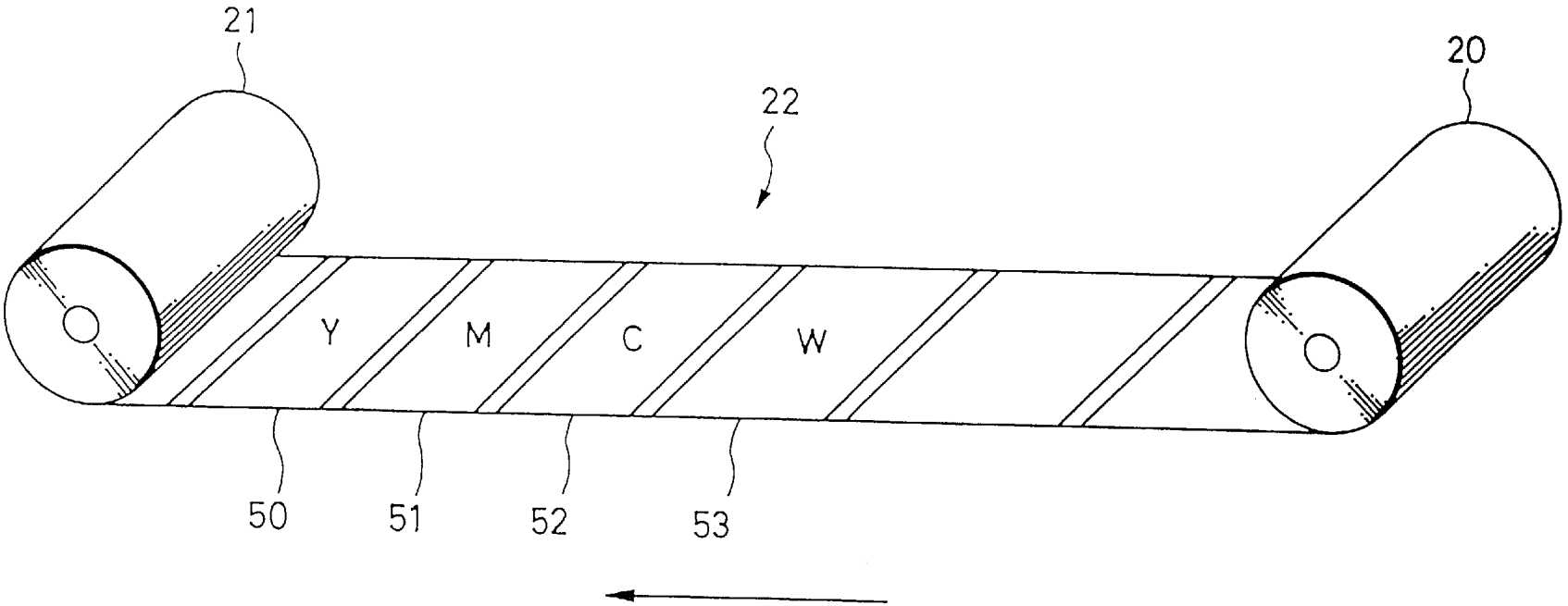
FIG. 5 is a diagram showing a ribbon according to the embodiment.

The image forming method suitable for this display system will be described. As described in detail with reference to FIGS. 5 and 6, the ribbon 22 having the yellow 50, the magneta 51, the cyan 52 and white 53 repeatedly disposed in this order from the takeup side to the supply side is employed as an ink ribbon for use in this color printer. The color printer described with reference to FIG. 1 carries out the sublimation thermal transfer of the images of the respective color components on a receiving layer 23*a* (print surface) side provided on the rear surface of the transparent sheet in the order of yellow, magenta and cyan, and then carries out the sublimation thermal transfer of the image of the white 53 on the entire surface thereof.

The noticeable point here lies in the fact that the printing apparatus of the display system according to the present invention transfers white not only on a portion corresponding to a white portion of the image supplied from the computer but also on the entire surface of the transparent sheet regardless of the color of the supplied image. Detailed operations thereof have been described with reference to FIGS. 3 and 4 which are flowcharts therefor.

As described above, this color printer forms the image of information for white and the images of informations for other colors in the same printing process. The white 53 has such components as have light diffusion, and a UV cut filter 23*b* is provided on the front surface of the transparent sheet 23.

A display method suitable for this display system will be described. The transparent sheet on which the image is formed by the above-mentioned image forming method is loaded onto the mesh plate 71 of the backlight display apparatus described with reference to FIGS. 7 and 8 in such a manner that a white layer 53 should be in contact with the mesh plate 71. Specifically, as schematically shown in FIG. 10, the rays of light 100 from the backlight 72 are irradiated through the white layer 53 on the transparent sheet 23. Therefore, when the rays of light from the backlight are irradiated on the rear surface side (white side) of the transparent sheet 23, the irradiated rays of light are diffused by the white layer. A degree of this diffusion can be properly set by changing a density of the white layer so that light of a sufficient amount can reach the transparent film side. A part of rays of light diffused by the white layer reaches a user 200 through a color image formed of the yellow layer 50, the magenta layer 51 and the cyan layer 52 on the transparent sheet. Therefore, the user 200 can watch the color image formed on the transparent sheet 23 from the front surface side of the transparent sheet.

Since elements of the white color components printed on the rear surface of the transparent sheet after printing operations for the respective colors are completed have a predetermined light diffusion property, it is not necessary to separately provide a diffusion plate and hence an illumination mechanism becomes simplified. Moreover, it is possible to uniformly diffuse illumination light from the rear side. Therefore, since the white layer diffuses the illumination light from the backlight, the illumination light from the backlight is prevented from been directly seen from the front side, which improves a quality of the displayed image. Moreover, since the image is displayed so as to be soft, it is possible to achieve an effect which is preferable in view of visuality.

Moreover, since the UV filter is employed, it is not necessary to carry out a special lamination processing and at the same time it is possible to prevent the color fading resulting from ultraviolet rays, which improves a quality of a displayed image.

Since white is printed on the entire rear surface of the transparent sheet in the same printing process after the respective colors are printed on the rear surface thereof, the white layer makes it difficult for the printed surface to be peeled off from the transparent sheet and hence can serve as a protective film.

While in the above embodiment white is printed on the entire rear surface of the transparent sheet in the same printing process after the respective color components of yellow, magenta and cyan are printed on the rear surface of the transparent sheet, the present invention is not limited to the printing processing using the white on the ink ribbon and a ribbon may have a non-transparent, white sheet which is provided at the succeeding stage of yellow, magenta and cyan regions and which, after the printing operation of the respective color components of yellow, magenta and cyan are finished, is used to bond the non-transparent, white sheet to the entire rear surface of the transparent sheet in the same printing processing. This process makes the print surface more difficult to be peeled off from the transparent sheet and also allows it to function as a protective film. This non-transparent, white sheet may also have an embossment such as a silk-pattern embossment or the like. In the above embodiment, the block component may be provided as well as the yellow, magenta and cyan components.

As described above, since the ink ribbon according to this embodiment is an ink ribbon used to print the color image on the transparent sheet by the sublimation thermal transfer system in which the yellow, magenta and cyan and, in addition thereto, the white ink having a diffusion effect are repeatedly provided in that order from the takeup side, it is possible to form the image by using the white ink in the same process employed when the images are formed by using other colors. Since the sublimation thermal transfer system is employed, each of dots on the print surface can have gradation and hence a high-quality color image can be obtained.

Since, when the ink ribbon according to the embodiment is employed, the printing operation carried out on the above transparent sheet by using the white ink is the printing operation carried out on the entire surface of the above transparent sheet, there can be obtained a color image having such a satisfactory quality that, when the irradiation light is irradiated on the white, the white prevents the irradiated light from being transmitted therethrough.

Since the ink ribbon according to the embodiment has the UV filter provided on the transparent sheet, it is not necessary to carry out any special laminating processing and at the same time it is possible to prevent the color fading resulting from the ultraviolet rays.

Since the above ink ribbon according to this embodiment has the above transparent sheet on one surface of which the above color image is printed and on the other surface of which the UV filter is provided, it is possible for the user to watch the printed color image from the front side of the transparent sheet and at the same time it is possible to prevent the color fading resulting from the ultraviolet rays.

Since the ink ribbon according to this embodiment is used to print the color images of yellow, magenta and cyan on the transparent sheet and then print white on the entire surface thereof, it is possible to form the image by using the white ink in the same process employed when the images are formed by using other colors. There can be obtained a color image having such a satisfactory quality that, when the irradiation light is irradiated from the white, the white prevents the irradiated light from being transmitted therethrough.

Since, when the ink ribbon according to this embodiment is employed for the printing processing, the color image to be printed on the above transparent sheet is printed while being inverted in the left and right direction, it is possible to watch the printed color image from the front surface side of the transparent sheet by printing the color image on the rear surface of the transparent sheet with the color image being inverted in the left and right direction.

Since the ink ribbon according to this embodiment is an ink ribbon used to print the color image on the transparent sheet by the sublimation thermal transfer system and in which the yellow, magenta and cyan and, in addition thereto, the white sheet having no transparency are repeatedly provided in that order from the takeup side, it is possible to form the image by using the white sheet in the same process employed when the images are formed by using other colors. Since the sublimation thermal transfer system is employed, each of dots on the print surface can have gradation and hence a high-quality color image can be obtained.

Since, when the ink ribbon according to the embodiment is employed, the printing operation carried out on the above transparent sheet by using the white sheet is the printing operation carried out on the entire surface of the above transparent sheet, there can be obtained a color image having such a satisfactory quality that, when the irradiation light is irradiated on the white sheet, the white sheet prevents the irradiated light from being transmitted therethrough.

Since the ink ribbon according to the embodiment has the UV filter provided on the transparent sheet, it is not necessary to carry out any special laminating processing and at the same time it is possible to prevent the color fading resulting from the ultraviolet rays.

Since the above ink ribbon according to this embodiment has the above transparent sheet on one surface of which the above color image is printed and on the other surface of which the UV filter is provided, it is possible for the user to watch the printed color image from the front side of the transparent sheet and at the same time it is possible to prevent the color fading resulting from the ultraviolet rays.

Since the ink ribbon according to this embodiment is used to print the color images of yellow, magenta and cyan on the transparent sheet and then print the white sheet on the entire surface thereof, it is possible to form the image by using the white sheet in the same process employed when the images of the other colors are formed. There can be obtained a color image having such a satisfactory quality that, when the irradiation light is irradiated on the white sheet, the white sheet prevents the irradiated light from being transmitted therethrough.

Since, when the ink ribbon according to this embodiment is employed for the printing processing, the color image to be printed on the above transparent sheet is printed while being inverted in the left and right direction, it is possible to watch the printed color image from the front surface side of the transparent sheet by printing the color image on the rear surface of the transparent sheet with the color image being inverted in the left and right direction.

The printing apparatus according to this embodiment is a printing apparatus for transferring the respective dyes of yellow, magneta and cyan color components provided on the ink ribbon onto a transferred member, which has the first memory for storing a print data of one image amount used for transferring the respective dyes of the yellow, magenta and cyan color components, the second memory for storing a control data used for the different printing operations corresponding to the printing operations for the above yellow, magenta and cyan color components and the printing operation for white, and the transfer means for transferring the respective dyes of yellow, magenta and cyan color components of the ink ribbon onto the transfer member and then transferring the dye of the white color component onto the transfer member based on the print data and the control data stored in the first and second memories. Therefore, since the respective color image of yellow, magenta and cyan are printed on the transparent sheet and then the white is printed on the entire surface thereof, there can be obtained a color image having such a satisfactory quality that, when the irradiation light is irradiated on the white layer, the white layer prevents the irradiated light from being transmitted therethrough.

Since in the printing apparatus according to this embodiment the above control data are values with respect to the tension of the ink ribbon between the supply reel for supplying the ink ribbon and the takeup reel for taking up the ink ribbon, the value with respect to the tension of the ink ribbon used when the respective color images of yellow, magenta and cyan are printed and the value with respect to the tension of the ink ribbon used when the white is printed are set, and thereby the ink ribbon being prevented from is bonded onto the transparent sheet when the white is printed on the entire rear surface of the transparent sheet.

Since in the printing apparatus according to this embodiment the above control data are values with respect to the tension of the ink ribbon between the supply reel for supplying the ink ribbon and the takeup reel for taking up the ink ribbon, the value with respect to the tension of the ink ribbon is set different from each other depending upon whether one of the yellow, magenta and cyan images or the white image is printed. Therefore, the value with respect to the tension of the ink ribbon used when the yellow, magenta and cyan images are printed and the value with respect to the tension used when the white is printed are set different from each other, and thereby the ink ribbon being prevented from is bonded onto the transparent sheet when the white is printed on the entire rear surface of the transparent sheet.

Since in the printing apparatus according to this embodiment the above control data are values with respect to the tension of the ink ribbon between the supply reel for supplying the ink ribbon and the takeup reel for taking up the ink ribbon, the value with respect to the tension of the ink ribbon used when the white is printed is set larger as compared with the value with respect to the tension of the ink ribbon used when each of the color images of yellow, magenta and cyan is printed. Therefore, the value with respect to the tension of the ink ribbon used when the white image is printed is set larger as compared with the value with respect to the tension of the ink ribbon used when each of the color images of yellow, magenta and cyan is printed, and thereby the ink ribbon is prevented from sagging and from being bonded onto the transparent sheet when the white is printed on the entire rear surface of the transparent sheet.

Since in the printing apparatus according to this embodiment the above control data is a head voltage applied to the thermal head of the above transfer means, the above head voltage used when the white is printed and the head voltage used when each of color images of the yellow, magenta and cyan are printed are set, and thereby the ink ribbon is prevented from being bonded onto the transparent sheet when the white is printed on the entire rear surface of the transparent sheet.

Since in the printing apparatus according to this embodiment the above control data is a head voltage applied to the thermal head of the above transfer means and the above head voltage used when the white is printed and the head voltage used when each of the color images of yellow, magenta and cyan is printed are set so as to be different from each other, the above head voltage used when the white is printed and the head voltage used when each of the color images of yellow, magenta and cyan is printed are set so as to be different from each other, and thereby the ink ribbon being prevented from is bonded onto the transparent sheet when the white is printed on the entire rear surface of the transparent sheet.

Since in the printing apparatus according to this embodiment the above control data is a head voltage applied to the thermal head of the above transfer means and the above head voltage used when the white is printed is set larger as compared with the head voltage used when each of the color images of yellow, magenta and cyan is printed, the high-density printing processing is carried out by setting the above head voltage used when the white is printed larger as compared with the head voltage used when each of the color images of the yellow, magenta and cyan is printed, and thereby the ink ribbon is prevented from being bonded onto the transparent sheet when the white image is printed on the entire rear surface of the transparent sheet.

Since the printing apparatus according to this embodiment has a detecting means for detecting the respective head portions of the yellow, magenta, cyan and white regions of the ink ribbon, the printing operations for yellow, magenta and cyan are carried out by searching for the heads of the yellow, magenta and cyan regions of the ink ribbon and then the printing operation for white is carried out by searching for the head portion of the white region thereof. Therefore, there can be obtained a color image having such a satisfactory quality that, when the irradiation light is irradiated on the white, the white prevents the irradiated light from being transmitted therethrough.

Since the printing apparatus according to this embodiment has a detecting means for detecting one surface of the above transferred member, the rear surface of the transparent sheet is detected thereby to print the white thereon after each of the color images of yellow, magenta and cyan is printed thereon. Therefore, there can be obtained a color image having such a satisfactory quality that, when the irradiation light is irradiated on the white, the white prevents the irradiated light from being transmitted therethrough.

Since the printing apparatus according to this embodiment employs the transparent sheet as the above transferred member and prints the white on the entire rear surface of the transparent sheet after printing each of the color images of yellow, magenta and cyan on the rear surface thereof, the irradiated light can be irradiated on the white printed on the entire rear surface thereof and the color image is printed while being inverted in the left and right direction. Therefore, it is possible to obtain a color image having a satisfactory quality without the irradiated light being transmitted to the front surface of the transparent sheet.

The backlight apparatus according to this embodiment has: the light source for irradiating rays of illumination light; the reflection plate for reflecting the rays of light irradiated from the above light to guide them toward the irradiation surface; the irradiated member which is disposed so that the irradiated rays of light from the above light source and guided by the above reflection plate are irradiated on the rear surface opposed to the above irradiation surface; the ink ribbon having the yellow; magenta and cyan regions and the white region having a diffusion effect repeatedly disposed in this order from the takeup side and used for printing the color image on the above irradiated member by the sublimation thermal transfer system; the first memory for storing the print data of one print frame amount used for transferring the dyes of the yellow, magenta an cyan components; the second memory for storing the control data for the printing operations which are different depending upon the color region used in the printing operation; and the transfer means for transferring the dyes of the yellow, magenta and cyan color components of the ink ribbon onto the above irradiated member and for then transferring the dye of the white component onto the above irradiated member, based on the print data and the control data stored in the above-mentioned first and second memories. The above color image is printed by using the printing apparatus to transfer the dye of each color component of yellow, magenta, cyan and white provided on the ink ribbon to the irradiated member. Therefore, it is possible to display the color image formed by employing the same processing for printing the image with the white ink and printing the images of other colors, and it is possible to obtain the color image having such a satisfactory quality that, when the irradiation light is irradiated on the white, the white prevents the irradiated light from being transmitted therethrough.

The above backlight apparatus according to the embodiment employs the transparent sheet as the above irradiated member. The transparent sheet is formed by printing each of the color images of yellow, magenta and cyan on the rear surface thereof. Then, white is printed on the entire rear surface thereof. The color image printed on the transparent sheet is inverted in the left and right direction, and thereby the irradiated rays of light are capable of being irradiated on the white printed on the entire rear surface thereof. Therefore, it is possible to obtain the color image having such a satisfactory quality that, when the irradiation light is irradiated on the white, the white prevents the irradiated light from being transmitted therethrough to the front surface of the transparent sheet.

When an image is printed on the transparent sheet by the printing apparatus according to the present invention with the ink ribbon according to the present invention being used and the image is displayed by irradiating the rays of light from the backlight apparatus according to the present invention on the printed transparent sheet, it is possible to use the image for an advertisement at a station and on street.

We claim:

1. A display system having an image forming apparatus for forming a color image on a transparent sheet and a display apparatus for displaying said color image formed on said transparent sheet, wherein:

said image forming apparatus includes means for performing a first process for forming a color image layer based on said color image on a rear surface of said transparent sheet by sublimating a first dye containing color components of yellow, magenta and cyan on an ink ribbon, and a second process for forming a white layer on a color image rear surface of said color image layer by sublimating a second dye having a color component of white on said ink ribbon after said first process; and said display apparatus includes means for irradiating light from said color image rear surface of said transparent sheet whereon said white layer is formed, and for displaying said color image on a front surface of said transparent sheet by allowing said light to transmit through said white layer and said color image layer.

2. The display system according to claim 1, wherein said image forming apparatus comprises:

ink ribbon drive means for driving said ink ribbon;

storage means for storing tension control data used for controlling a tension of said ink ribbon; and control means for controlling, based on said tension control data stored in said storage means, said ink ribbon drive means so that said tension of said ink ribbon is set to a first tension value in said first process and for controlling said ink ribbon drive means so that said tension of said ink ribbon is set to a second tension value in said second process.

3. The display system according to claim 2, wherein said second tension value is larger than said first tension value.

4. The display system according to claim 2, wherein:

said image forming apparatus further comprises transparent sheet drive means for driving said transparent sheet by one line amount in said first process and said second process; and said control means controls said transparent sheet drive means and said ink ribbon drive means so that said white layer is formed having a uniform thickness on said color image rear surface of said color image layer.

5. The display system according to claim 1, wherein said image forming apparatus comprises:

storage means for storing a first reference head voltage and a second reference head voltage supplied to a thermal head;

head drive means for controlling, based on image data, said first reference head voltage and said second reference head voltage, a head voltage supplied to said thermal head for sublimating a dye of said ink ribbon; and control means for controlling in said first process said head drive means so that said thermal head is driven based on said first reference head voltage and for controlling in said second process said head drive means so that said thermal head is driven based on said second reference head voltage.

6. The display system according to claim 5, wherein said second reference head voltage is lower than said first reference head voltage.

7. The display system according to claim 5, wherein said control means of said image forming apparatus controls said head drive means in said second process so that, when said display means irradiates said light on said transparent sheet from said color image rear surface of said white layer formed thereon, said white layer has a density whereby a first part of said light is diffused by said white layer and a second part of said light is transmitted through said white layer to said color image layer.

8. The display system according to claim 5, wherein:

said image forming apparatus further comprises transparent sheet drive means for driving said transparent sheet by one line amount in said first process and said second process; and said control means controls said transparent sheet drive means and said head drive means so that said white layer s formed having a uniform thickness on said color image rear surface of said color image layer.

9. The display system according to claim 1, wherein said color image transferred onto said transparent sheet in said first process is an image reversed in the left and right direction relative to supplied image data.

10. The display system according to claim 1, wherein:

yellow, magenta and cyan dyes on said ink ribbon contain components used for forming said color image layer on said transparent sheet; and an ink for said white layer has a density and components so that, when said light is irradiated on said transparent sheet from said color image rear surface whereon said white layer is formed, said white layer diffuses a first part of said light and permits a second part of said light to be transmitted through said white layer toward said color image layer.

11. A display method for forming a color image on a transparent sheet by an image forming apparatus to display said color image formed on said transparent sheet, said display method comprising the steps of:

forming, in a first process, a color image layer based on said color image by sublimating a dye containing yellow, magenta and cyan color components on an ink ribbon on said color image on a rear surface of said transparent sheet;

forming, in a second process, a white layer on a color image rear surface of said color image layer by sublimating a dye containing a white color component on said ink ribbon; and irradiating light on said transparent sheet from said color image rear surface whereon said white layer is formed to thereby display said color image on a front surface side of said transparent sheet by transmitting said light through said white layer and said color image layer.

12. The display method according to claim 11, wherein said image forming apparatus comprises:

ink ribbon drive means for driving said ink ribbon; and storage means for storing tension control data used for controlling a tension of said ink ribbon; and said display method further comprises the steps of:

controlling, in said first process said ink ribbon drive means, based on said tension control data stored in said storage means, so that said tension of said ink ribbon is set to a first tension value; and controlling, in said second process, said ink ribbon drive means, based on said tension control data stored in said storage means, so that said tension of said ink ribbon is set to a second tension value.

13. The display method according to claim 12, wherein said second tension value is larger than said first tension value.

14. The display method according to claim 12, wherein:

said image forming apparatus further comprises transparent sheet drive means for driving said transparent sheet by one line amount in said first process and said second process; and said display method further comprises the step of controlling in said second process, said transparent sheet drive means and said ink ribbon drive means so that said white layer is formed having a uniform thickness on said color image rear surface of said color image layer.

15. The display method according to claim 11, wherein said image forming apparatus comprises:

storage means for storing a first reference head voltage and a second reference head voltage supplied to said thermal head; and head drive means for controlling, based on said image data, said first reference voltage and said second reference head voltage, a head voltage supplied to said thermal head for sublimating a dye of said ink ribbon; and said display method further comprising the steps of:

controlling, in said first process, said head drive means so that said thermal head is driven based on said first reference head voltage; and controlling, in said second process, said head drive means so that said thermal head is driven based on said second reference head voltage.

16. The display method according to claim 15, wherein said second reference head voltage is lower than said first reference head voltage.

17. The display method according to claim 15, further comprising the steps of:

forming in said second process, said white layer so that when said light is irradiated on said transparent sheet from said color image rear surface whereon said white layer is formed, said white layer has a density whereby a first part of said light is diffused and a second part of said light is transmitted through said white layer to said color image layer.

18. The display method according to claim 15, wherein:

said image forming apparatus further comprises transparent sheet drive means for driving said transparent sheet by one line amount in said first process and said second process and said display method further comprises the step of controlling, in said second process, said transparent sheet drive means and said head drive means so that said white layer is formed having a uniform thickness on said color image rear surface of said color image layer.

19. The display method according to claim 11, wherein: said color image transferred onto said transparent sheet in said first process is an image inverted in the left and right direction relative to supplied image data.

20. The display method according to claim 11, wherein:

yellow, magenta and cyan dyes on said ink ribbon contain components used for forming said color image layer on said transparent sheet; and an ink for said white layer has a density and components so that, when said light is irradiated on said transparent sheet from said color image rear surface whereon said white layer is formed, said white layer diffuses a first part of said light and permits a second part of said light to be transmitted therethrough through said white layer toward said color image layer.

21. A printing apparatus for transferring dyes of respective color components of yellow, magenta, cyan and white provided on an ink ribbon to a transferred member, said printing apparatus comprising:

a first memory for storing print data of one print frame used for transferring dyes of said respective color components of yellow, magenta and cyan;

a second memory for storing control data used for controlling a printing operation which is different depending upon whether one of yellow, magenta and cyan images and a white image is printed; and control means for transferring dyes of respective color components of yellow, magenta and cyan on said ink ribbon to said transferred member based on said print data and said control data respectively stored in said first memory and said second memory and for transferring a dye of a white color component onto an entire surface of said transferred member.

22. A printing apparatus according to claim 21, wherein said control data is a value with respect to a tension of a supply reel for supplying said ink ribbon and of a take up reel for taking up said ink ribbon.

23. The printing apparatus according to claim 21, wherein said control data is a value with respect to a tension of a supply reel for supplying said ink ribbon and of a takeup reel for taking up said ink ribbon, and said value with respect to said tension is set differently depending upon whether one of said yellow, magenta and cyan images and said white image is printed.

24. The printing apparatus according to claim 21, printing apparatus, wherein said control data is a value with respect to a tension of a supply reel for supplying said ink ribbon and of a take up reel for taking up said ink ribbon, and said value with respect to said tension employed when a white image is printed is set larger than said value with respect to said tension employed when one of said yellow, magenta and cyan images is printed.

25. The printing apparatus according to claim 21, wherein said control data is a head voltage applied to a thermal head of said control means.

26. The printing apparatus according to claim 21, wherein said control data is a head voltage applied to a thermal head of said control means, and said head voltage is set differently depending upon whether one of said yellow, magenta and cyan images and said white image is printed.

27. The printing apparatus according to claim 21, wherein said control data is a head voltage applied to a thermal head of said control means, and said head voltage employed when a white image is printed is set larger than said head voltage employed when one of said yellow, magenta and cyan images is printed.

28. The printing apparatus according to claim 21, further comprising detecting means for detecting head portions of yellow, magenta, cyan and white regions of said ink ribbon.

29. The printing apparatus according to claim 21, further comprising detecting means for detecting one surface of said transferred member.

30. The printing apparatus according to claim 33, wherein:

said transferred member is a transparent sheet;

each of said yellow, magenta and cyan images are printed on a rear surface of said transparent sheet;

said white image is printed on an entire rear surface of said yellow magenta and cyan images;

irradiation of light on said white image printed on said entire rear surface is permitted; and a color image printed on said transparent sheet is printed being reversed in the left and right direction relative to image data.

31. An image forming apparatus for forming a color image on a transparent sheet, wherein:

a first process of forming a color image layer based on said color image on a rear surface of said transparent sheet by sublimating dyes containing respective color components of yellow, magenta and cyan on an ink ribbon is performed; and a second process of forming a white layer on an entire surface of a color image rear surface of said color image layer by sublimating a dye containing a white component on said ink ribbon is performed after said first process.

32. The image forming apparatus according to claim 31, wherein said white layer is formed for displaying, when light is irradiated on said transparent sheet from a side of said color image rear surface where said white layer is formed, said color image on a front surface side of said transparent sheet by a part of said light transmitted through said white layer.

33. The image forming apparatus according to claim 31, comprising:

ink ribbon drive means for driving said ink ribbon;

storage means for storing tension control data used for controlling a tension of said ink ribbon; and control means for, based on said tension control data stored in said storage means, ontrolling said ink ribbon drive means so that said tension of said ink ribbon is set to a first tension value in said first process and for controlling said ink ribbon drive means so that said tension of said ink ribbon is set to a second tension value in said second process.

34. The image forming apparatus according to claim 33, wherein said second tension value is larger than the said first tension value.

35. The image forming apparatus according to claim 33, further comprising:

transparent sheet drive means for driving said transparent sheet by one line amount in said first process and said second process; and wherein said control means controls said transparent sheet drive means and said ink ribbon drive means so that said white layer is formed having a uniform thickness on said color image rear surface of said color image layer.

36. The image forming apparatus according to claim 33, wherein said storage means comprises first storage means and said control means comprises first control means and further comprising:

second storage means for storing a first reference head voltage and a second reference head voltage supplied to a thermal head;

head drive means for controlling, based on image data and said first reference head voltage and said second reference head voltage, a head voltage supplied to said thermal head for sublimating a dye of said ink ribbon; and second control means for controlling, in said first process, said head drive means so that said thermal head is driven based on said first reference head voltage and for controlling, in said second process, said head drive means so that said thermal head is driven based on said second reference head voltage.

37. The image forming apparatus according to claim 36, wherein said second reference head voltage is lower than said first reference head voltage.

38. The image forming apparatus according to claim 36, wherein said second control means controls said head drive means, in said second process so that, when light is irradiated on said transparent sheet from a side of said color image rear surface whereon said white layer is formed, said white layer has a density whereby a first part of said light is diffused by said white layer and second part of said light is transmitted through said white layer toward said color image layer.

39. The image forming apparatus according to claim 36, further comprising transparent sheet drive means for driving said transparent sheet by one line amount in said first process and said second; and wherein said second control means controls said transparent sheet drive means and said head drive means so that said white layer is formed having a uniform thickness on said color image rear surface of said color image layer.

40. A display system, comprising:

a light for producing irradiation light;

a reflection plate for reflecting said irradiation light from said light to guide said irradiation light to an irradiation surface; and an irradiated member disposed so that said irradiation light guided by said reflection plate to said irradiation surface is irradiated on a rear surface of said irradiation member opposed to said irradiation surface; and wherein said irradiated member being has printed thereon a color image by using a printing apparatus including:

an ink ribbon having respective yellow, magenta, cyan and white inks having a diffusion effect repeatedly disposed on said ink ribbon from a takeup side and used for printing said color image on said irradiated member by sublimation in a thermal transfer system;

a first memory for storing print data of one print frame amount used for transferring dyes of yellow, magenta and cyan color components of said ink ribbon;

a second memory for storing control data for printing operations which are mutually different depending upon a color region used in a printing operation; and transfer means for transferring said dyes of said yellow, magenta and cyan color components of said ink ribbon onto said irradiated member and for transferring a dye of a white color component onto said irradiated member, based on said print data and said control data stored in said first memory and said second memory.

41. The display system according to claim 40, wherein:

said irradiated member is a transparent sheet;

said transparent sheet is printed with a color image of yellow, magenta and cyan on a rear surface of said transparent sheet and printed with a white color on an entire rear surface of said transparent sheet printed with said color image;

said color image printed on said transparent sheet being reversed in a left and right direction; and said irradiation light is irradiated on said white color printed on said entire rear surface of said transparent sheet printed with said color image.

* * * * *